US005136817A

United States Patent [19]

Tabata et al.

[11] Patent Number: 5,136,817

[45] Date of Patent: Aug. 11, 1992

[54] AUTOMATIC LAPPING APPARATUS FOR PIEZOELECTRIC MATERIALS

[75] Inventors: Makoto Tabata; Hiroshi Takezawa, both of Furukawa, Japan

[73] Assignee: Nihon Dempa Kogyo Co., Ltd., Tokyo, Japan

[21] Appl. No.: 662,444

[22] Filed: Feb. 28, 1991

[30] Foreign Application Priority Data

Feb. 28, 1990 [JP] Japan ..... 2-050452
Jun. 29, 1990 [JP] Japan ..... 2-173846
Dec. 25, 1990 [JP] Japan ..... 2-412942

[51] Int. Cl.[5] ..... B24B 49/04

[52] U.S. Cl. ..... 51/165.71; 51/118; 51/165 R; 51/133

[58] Field of Search ..... 51/165 R, 165.71, 118, 51/131.1, 131.3, 131.4, 132–133

[56] References Cited

U.S. PATENT DOCUMENTS 4,197,676 4/1980 Sauerland ..... 51/118
4,199,902 4/1980 Sauerland ..... 51/118
4,407,094 10/1983 Bennett et al. ..... 51/165 R

*Primary Examiner*—Robert A. Rose
*Attorney, Agent, or Firm*—Oblon, Spivak, McClelland, Maier & Neustadt

[57] ABSTRACT

An automatic lapping apparatus for lapping a piezoelectric material has upper and lower lapping plates, and a carrier disposed between the plates, for holding a piezoelectric material so that it is sandwiched between the plates. The carrier is rotatable to lap the piezoelectric material parallel to the lapping surfaces of the plates while supplying a lapping slurry therebetween. The apparatus also includes a sweep oscillator for applying a sweep signal corresponding to the count of a counter, through an AGC amplifier and a resistor to an electrode supported by one of the plates, a comparing circuit for determining whether the quartz crystal wafer is present underneath the electrode based on the level of the sweep signal applied to the electrode, a memory for storing output data from the comparing circuit at an address corresponding to the count, a dip detector for detecting a dip in the signal applied to the electrode and stopping operation of the counter, a frequency detector for reading the frequency from the sweep oscillator when the dip is detected and the presence of the piezoelectric material underneath the electrode is detected, a frequency determining circuit for determining whether the read frequency is a true resonant frequency of the quartz crystal wafer, a frequency comparator for determining that lapping is completed when the true resonant frequency falls within a predetermined target frequency, and an drive unit control circuit for stopping the carrier when the lapping is completed.

1 Claim, 4 Drawing Sheets

AUTOMATIC LAPPING APPARATUS FOR PIEZOELECTRIC MATERIALS

BACKGROUND OF THE INVENTION

1. Field of the Invention

The present invention relates to an automatic lapping apparatus for grinding or lapping a fragile piezoelectric material such as a quartz crystal wafer or the like to a predetermined thickness.

2. Description of the Prior Art

Quartz oscillators whose resonant frequencies depend on the thickness of the quartz crystals thereof are heretofore manufactured by cutting off a quartz crystal into a wafer at a certain angle with respect to a crystallographic axis thereof and lapping the quartz crystal wafer to a certain thickness for a desired resonant frequency. Various lapping apparatus for lapping quartz crystal wafers flatwise are known in the art. Of those known lapping apparatus, planetary-gear lapping apparatus are now in wide use.

One type of planetary-gear lapping apparatus includes a sun gear rotatable about its own axis and an internal gear disposed around the sun gear in spaced relationship thereto. A plurality of circular carriers, which have holes for holding quartz crystal wafers to be lapped, are thicker than the quartz crystal wafers, and have gear teeth on their outer circumferential edges, are held in mesh with the sun gear and the internal gear for planetary motion. Upper and lower lapping plates are disposed respectively on the upper and lower surfaces of the carriers. The sun gear, the internal gear, and the upper and lower lapping plates are rotated independently of each other. Between the upper and lower lapping plates, there is supplied a lapping slurry which is a mixture of water, oil, or the like and an abrasive powder of carborundum, aluminum oxide, or the like.

A process of lapping the quartz crystal wafers of piezoelectric material with such a lapping apparatus will now be described below.

The resonant frequency f0 of an AT-cut quartz oscillator which vibrates in the thickness shear mode is approximately given by:

$$f0 = 1670/a \text{ (KHz)} \quad (1)$$

where a is the thickness of the quartz crystal wafer.

Therefore, the resonant frequency of an At-cut quartz oscillator depends entirely on the thickness thereof. An AT-cut quartz crystal wafer whose resonant frequency is 16.70 MHz has a thickness of 0.1 mm. An AT-cut quartz crystal wafer having a resonant frequency of 16.71 MHz is 0.09994 mm thick. Therefore, the thickness of an At-cut quartz crystal wafer has to be reduced 0.00006 mm in order to increase the resonant frequency by 10 KHz. Stated otherwise, in order to lap a quartz crystal wafer with an accuracy in terms of frequency increments of 10 KHz, the thickness of the quartz crystal wafer has to be controlled in steps of 0.00006 mm.

It is therefore desired that lapping apparatus for quartz crystal wafers be capable of controlling the wafer thickness highly accurately and stopping the lapping plates automatically when the wafer is lapped to a desired thickness.

One relatively simple lapping control process which has been carried out on a conventional lapping apparatus effects empirical control of the lapping time under a certain load at a certain rotational speed for lapping a quartz crystal wafer to a desired thickness. However, such a method is unable to meet thickness requirements for quartz crystal wafers for use as quartz oscillators. An attempt to increase the thickness accuracy with this lapping control process requires the lapping apparatus to be stopped frequently and the quartz crystal wafers to be removed for the measurement of their resonant frequencies to check the thicknesses.

When the upper and lower lapping plates are detached for the removal of the quartz crystal wafers, many of them tend to be dislodged from the carries due to the viscosity and surface tension of the lapping slurry. After the resonant frequencies of the quartz crystal wafers have been measured, it is necessary to put all the quartz crystal wafers back on the carriers before they start being lapped again. The reattaching process is tedious and time-consuming, and results in a low efficiency. Particularly, lapping apparatus for industrial use, which simultaneously lap many wafers, ranging from several hundred wafers to one thousand and several hundred wafers, would find it impractical to have all the wafers removed for measurement in the middle of a lapping process.

It is also known to employ an air gage or an electrostatic capacitance detector for measuring the distance between the upper and lower lapping plates to indirectly measure the thickness of quartz crystal wafers therebetween, or to employ a mechanical stopper of hard material such as diamond between the upper and lower lapping plates so that the quartz crystal wafers will not be lapped down below a certain given thickness. These processes are however only capable of controlling the wafer thickness with an accuracy of about 0.005 mm at maximum, which is far lower than the accuracy required for quartz crystal wafers.

According to another lapping process, the resonant frequency of a piezoelectric material such as a quartz crystal wafer is measured while the quartz crystal wafer is being lapped, so that the quartz crystal wafer can be lapped highly accurately. More specifically an electrode is disposed on the upper lapping plate, for example, to provide an electric coupling to a quartz crystal wafer being lapped. A high-frequency signal voltage is applied to the electrode, and the frequency of the signal is varied in a given frequency range.

When the quartz crystal wafer is present immediately below the electrode and the resonant frequency of the quartz crystal wafer coincides with the frequency of the high-frequency signal applied to the electrode, the apparent impedance of the quartz crystal wafer is very low and corresponds t the equivalent resistance of the equivalent circuit of the quart crystal wafer. Therefore, monitoring the impedance of the quartz crystal wafer while it is being lapped allows the operator to know the resonant frequency of the quartz crystal wafer, and hence to determine when to finish the lapping operation.

A lapping apparatus for a quartz crystal wafer based on the above principle is disclosed in U.S. Pat. No. 4,407,094, for example. The disclosed lapping apparatus is shown in FIG. 3 of the accompanying drawings. An output signal from a sweep oscillator 126 is applied through a pin diode 120 to an electrode. The voltage applied to the pin diode 120 is also applied through a terminal 122, a 2:1 voltage divider 152, and an envelope detector 154 to one input terminal of a comparator 156.

The voltage produced from the pin diode 120, i.e., the voltage applied to the electrode, is applied through a terminal 124 and an envelope detector 158 to the other input terminal of the comparator 156.

An output signal from the comparator 156 is used to control the impedance of the pin diode 120 to equalize the voltage applied to the electrode to ½ of the output voltage of the sweep frequency generator 126.

The output signal from the comparator 156 is compared with a preset voltage from a variable resistor 162 by a comparator 160, whose output signal is used to control a switch 130. The switch 130 is connected between the terminal of the electrode to which the voltage from the pin diode 120 is applied and a signal processor which is connected to the circuit arrangement shown in FIG. 3. When the impedance of the quartz crystal wafer below the electrode becomes smaller than a predetermined value, the switch 130 is closed to allow the signal processor to operate.

With the proposed circuit arrangement, the impedance of the pin diode 120 connected to the output terminal of the sweep oscillator 126 is controlled in order to absorb large changes in the impedance of the quartz crystal wafer below the electrode.

Since, however, the voltage across the pin diode 120 is applied to the comparator 156 and closed-loop control is effected to control the impedance of the pin diode 120 based on the output signal from the comparator 156, the time constant of the control circuit tends to be large. The upper and lower lapping plates rotate at high speed, and the quartz crystal wafer is positioned below the electrode only for a very short period of time. Therefore, if the time constant is too large, the resonance of the quartz crystal wafer cannot reliably be detected.

Varying the impedance of the pin diode 120 lessen variations in the voltage level applied to the electrode, with the advantage that noise in short periods of time can be masked and removed. This advantage however poses a problem in that when the impedance varies in a very short period of time as when the quartz crystal wafer leaves from below the electrode, such an impedance change cannot be detected.

For example, even if the impedance of the quartz crystal wafer varies as 5 V in a period of 20 ms as shown in FIG. 4, the voltage will be reduced to 3 V in a period of 5 ms as shown in FIG. 5 and applied to the signal processor of a following stage.

If a change of 5 V in a period of 2 ms as shown in FIG. 6 is applied as a change of 4 v in a period of 1.5 ms as shown in FIG. 7 to the signal processor. It is difficult to distinguish between such an impedance change and an abrupt dip due to resonance of the quartz crystal wafer.

SUMMARY OF THE INVENTION

In view of the aforesaid problems of the conventional automatic lapping apparatus for piezoelectric materials, it is an object of the present invention to provide an automatic lapping apparatus for automatically lapping quartz crystal wafers while accurately measuring the resonant frequency thereof, the automatic lapping apparatus being free from noise-induced errors.

According to the present invention, there is provided an automatic lapping apparatus for lapping a piezoelectric material, comprising a pair of parallel, confronting lapping plates having confronting lapping surfaces, a carrier disposed between the lapping plates, for holding a piezoelectric material sandwiched between the lapping surfaces of the lapping plates, a drive unit for driving the carrier in a planetary motion between the lapping plates to lap the piezoelectric material parallel to the lapping surface while supplying a lapping slurrying therebetween, an electric supported on one of the lapping plates in electrically insulated relationship thereto, the electrode having a tip end positioned at the lapping surface of said one lapping plate, a counter for counting a clock signal having a constant frequency, a digital-to-analog converter for converting the count of the counter into an analog signal corresponding to the count, a sweep oscillator for generating a sweep signal whose frequency depends on the analog signal from the digital-to-analog converter, an AGC amplifier for amplifying the sweep signal from the sweep oscillator to a fixed amplitude and applying the amplified sweep signal through a fixed resistor to a terminal of the electrode, a comparing circuit for detecting the signal at the terminal of the electrode and comparing the detected signal with a first reference voltage with a relatively long first time constant to determine whether the piezoelectric material is present underneath the electrode, a memory for storing output data from the comparing circuit at an address corresponding to the count of the counter, a dip detector for detecting an envelope of the signal at the terminal of the electrode and detecting a dip in the signal based on a dip in the envelope with a second time constant which is shorter than the first time constant, a sweep control circuit for inactivating the counter when the dip in the signal is detected by the dip detector, a frequency detector for successively decrementing addresses of said memory from the address corresponding to the count of the counter for a predetermined number of times and reading the output data from the decremented addresses, when the dip in the signal is detected by the dip detector, and for reading the frequency generated by the sweep oscillator at the time the dip in the signal is detected, only when all the output data stored in the memory indicate the presence of the piezoelectric material underneath said electrode, as frequency data into a register thereof, a frequency determining circuit for determining the frequency data as representing a true resonant frequency of the piezoelectric material when the difference between frequency data successively read into the register is smaller than a predetermined value, a frequency comparator for determining that a lapping process is completed when the true resonant frequency determined by the frequency determining circuit falls in a given range from a predetermined target frequency, and an drive unit control circuit for controlling the drive unit to stop driving the carrier in response to the determination by the frequency comparator that the lapping process is completed.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
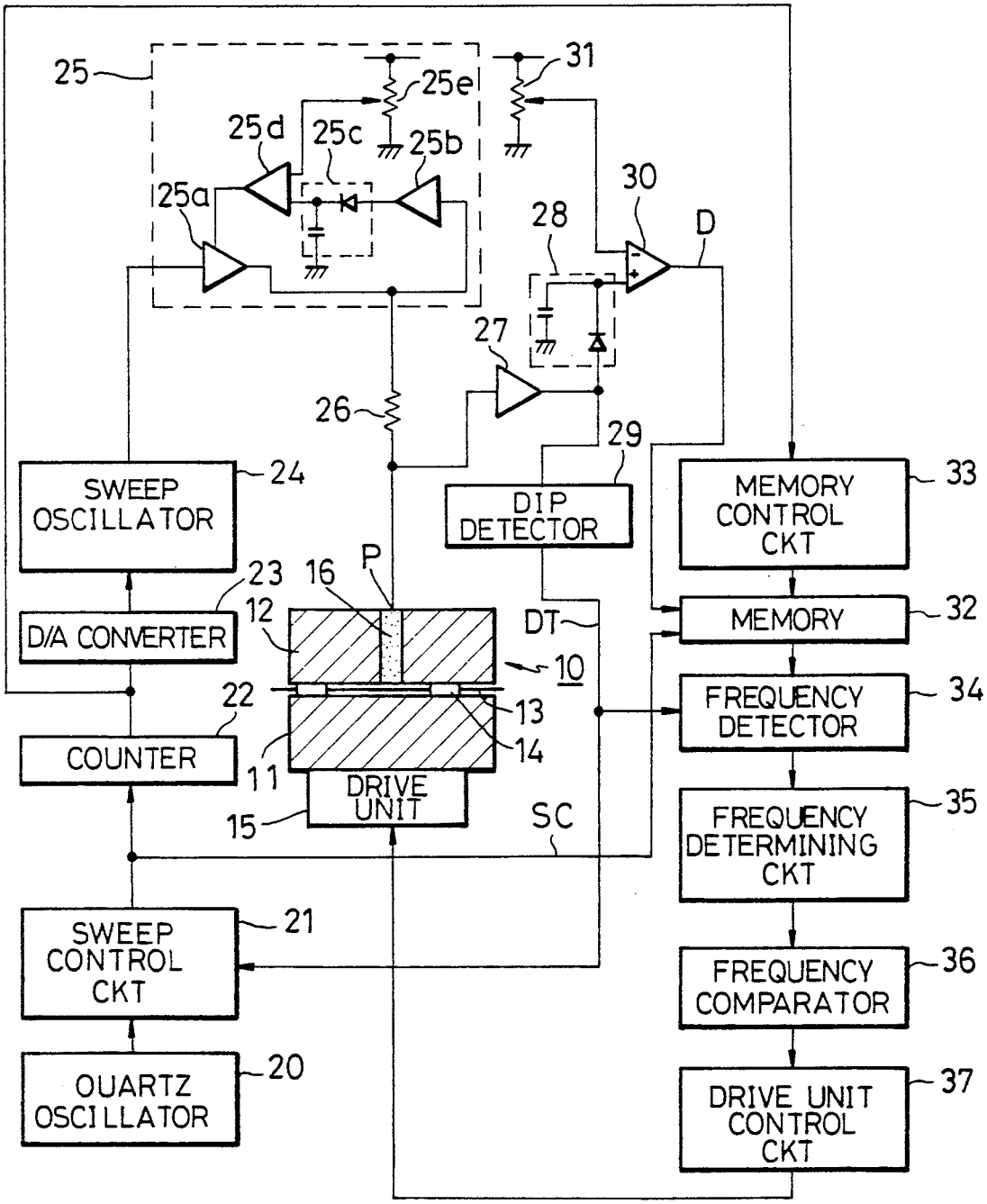
FIG. 1 is a block diagram of an automatic lapping apparatus according to the present invention.

As shown in FIG. 1, an automatic lapping apparatus according to the present invention includes a lapping assembly 10 which comprises a lower lapping plate 11 and an upper lapping plate 12 which confront each other, and a thin-plate carrier 13 disposed between the lapping plates 11, 12. The carrier 13 has holes for holding a plurality of piezoelectric materials 14, e.g., quartz crystal wafers, therein which are sandwiched between the lapping surfaces of the lapping plates 11, 12. While a lapping slurry is being supplied between the lower and upper lapping plates 11, 12, the carrier 13 is drived for planetary motion by a drive unit 15 to grind or lap each quartz crystal wafer 14 flatwise between and parallel to the confronting lapping surfaces of the lapping plates 11, 12. The upper lapping plate 12 has a through hole defined transversely therein, and an electrode 16 is disposed in the hole. The electrode 16 is an electric conductor of brass or the like, and has its outer circumferential surface insulated from the plate 12 by an insulating material. The electrode 16 in the hole in the upper lapping plate 12 has a lower tip end lying flush with the lapping surface of the upper lapping plate 12.

A quartz oscillator 20 produces a clock signal of constant frequency. When no detected dip signal DT is supplied, a sweep control circuit 21 transmits the clock signal supplied from the quartz oscillator 20. When a detected dip signal Dt is supplied, the sweep control circuit 21 blocks the transmission of the supplied clock signal.

A counter 22, which may be a binary counter, counts up the clock signal from the sweep control circuit 21. When the counter 22 reaches a maximum count (e.g., 4096), it clears the count, and starts to count up the clock signal again from 0.

A digital-to-analog (D/A) converter 23 converts the count from the counter 22 into an analog signal of a substantially ramp waveform which is applied to a sweep oscillator 24.

The sweep oscillator 24 is in the form of a tuning circuit comprising a voltage-to-capacitance converter, e.g., a voltage-variable capacitor and a inductor, and produces a sweep signal in a certain frequency range including an expected resonant frequency of a quartz crystal wafer, the frequency of the signal responding to the output voltage of the D/A converter 23. The sweep signal from the sweep oscillator 24 is then applied to an automatic gain control (AGC) amplifier 25.

A variable-gain amplifier **25*a* of the AGC amplifier 25 receives the sweep signal from the sweep oscillator 24. The amplified output signal from the variable-gain amplifier 25*a* is supplied through a buffer amplifier 25*b* and a detector 25*c* to a comparator 25*d*, by which the signal is compared with a gain reference voltage from a reference voltage generator 25*e*. The output signal from the comparator 25*d* is fed back to a gain control terminal of the variable-gain amplifier 25*a* to control the amplified output signal of the variable-gain amplifier 25*a*** at a constant level.

The amplified output signal from the AGC amplifier 25 is supplied through a fixed register 26 to a signal applying terminal P of the electrode 16.

Since the carrier 13 rotates in planetary motion, the lapping slurry which is mainly composed of water and the carrier 13 which is mainly made of steel are positioned, or the quartz crystal wafer 14 is positioned immediately underneath the electrode 16 upon rotation of the carrier 13.

With respect to the sweep signal from the sweep oscillator 24, the carrier 13 has a lowest impedance, the lapping slurry has a next lowest impedance, and the quartz crystal wafer 14 which is not resonating has a highest impedance. When the impedance of the material underneath the electrode 16 is lower, the voltage of the sweep signal at the terminal P of the electrode 16 is also lower. Conversely, when the impedance of the material underneath the electrode 16 is higher, the voltage at the terminal P is higher. The voltage at the terminal P is applied through a buffer amplifier 27 to a detector 28 and a dip detector 29.

A comparator circuit, which has a relatively long first time constant, is constructed with the detector 28, a first comparator 30 and a reference voltage generator 31.

The detector 28 applies a detected output signal to a first comparator 30 and the first comparator 30 compares the applied signal with a first reference voltage from a reference voltage generator 31 to determine whether the quartz crystal wafer 14 is present underneath the electrode 16.

The impedance of the quartz crystal wafer 14 which is not resonating and lies underneath the electrode 16 is much higher than the impedance of the lapping slurry positioned underneath the electrode 16, since the impedance of the carrier 13 is lower than the impedance of the lapping slurry. The impedance of the quartz crystal wafer 14 is far higher than the impedance of the carrier 13.

The impedance of the quartz crystal wafer 14 which is resonating is very low, and lower than the impedance of the lapping slurry. Since the Q factor of the quartz crystal wafer 14 is high, and a change (dip) in the voltage of the signal at the terminal P while the quartz crystal wafer 14 is resonating abruptly occurs in an extremely short period of time, the first comparator 30 processes the voltage at the terminal P of the electrode 16 with the relatively long time constant, for accurately detecting the signal voltage at the time the quartz crystal wafer 14 is positioned immediately below the electrode 16, without being affected by a abrupt reduction in the impedance of the quartz crystal wafer 14 when it resonates. Since any randomly produced noise is abruptly caused in a very short period of time, it can be masked and is not erroneously detected as a wafer position signal since a change in the voltage at the terminal P is processed with the relatively long time constant.

When the output voltage from the detector 28 is higher than the first reference voltage, the output data D from the first comparator 30 goes high in level ("1"), indicating that the quartz crystal wafer 14 is positioned below the electrode 16.

A memory control circuit 33 produces the count of the counter 22 as an output address signal ADR indicating an address for a memory 32. In synchronism with the clock signal SC from the sweep control circuit 21, the memory 32 stores the output data D ("1" or "0") from the first comparator 30 at the address indicated by the address signal ADR.

Figure 2:
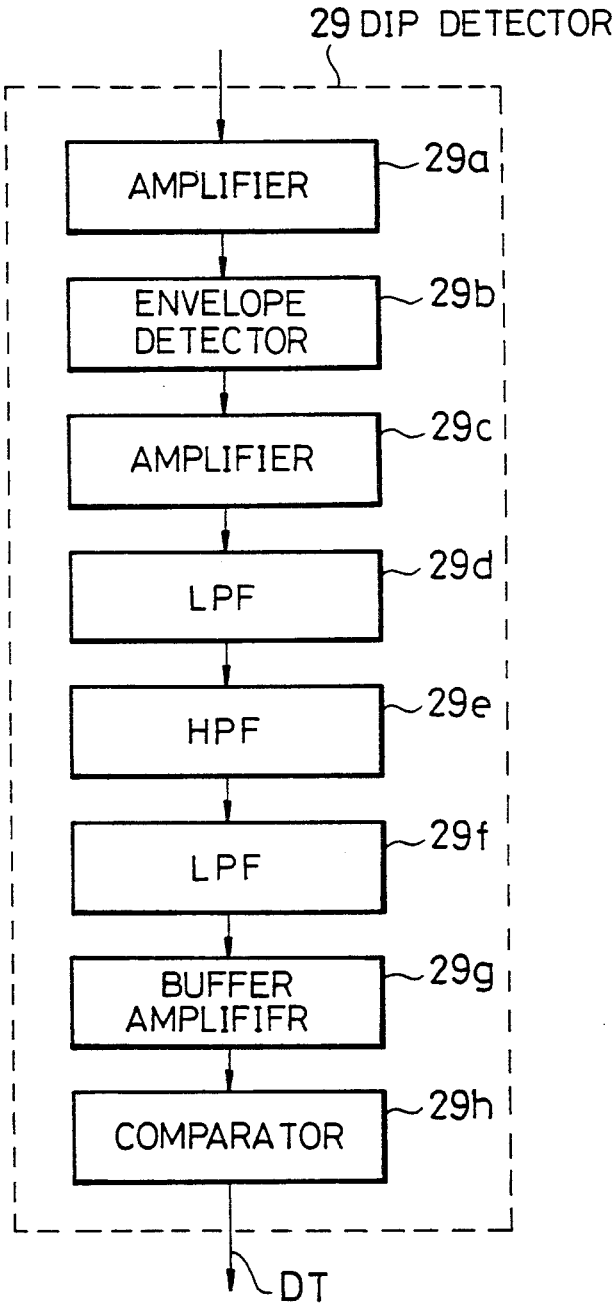
FIG. 2 is a block diagram of a dip detector in the automatic lapping apparatus shown in FIG. 1.
Figure 3:
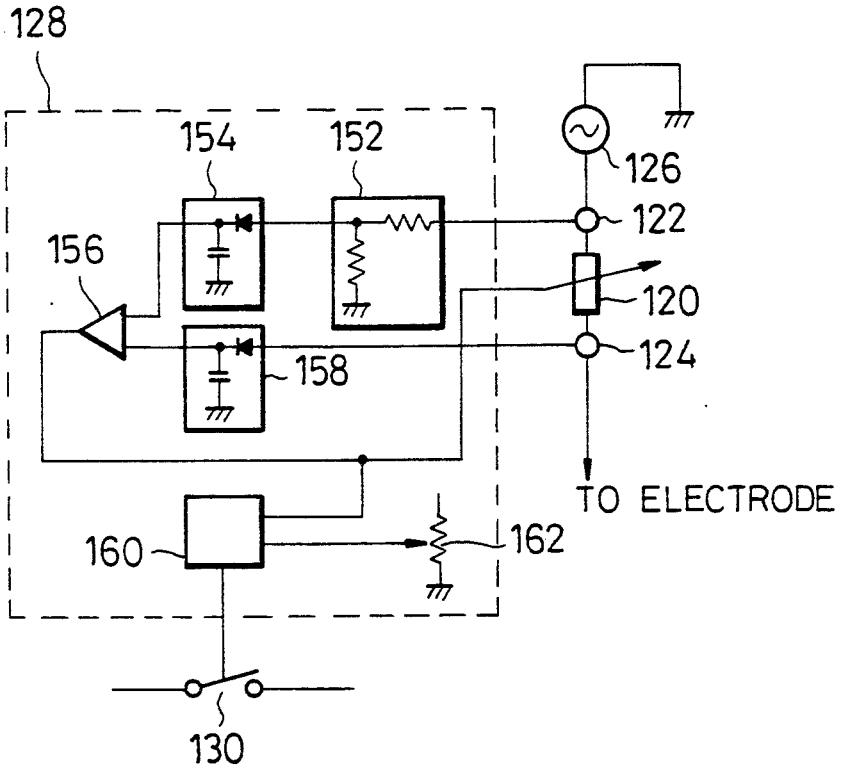
FIG.3 PRIOR ART
FIG. 3 is a block diagram of a conventional lapping apparatus.
Figure 4:
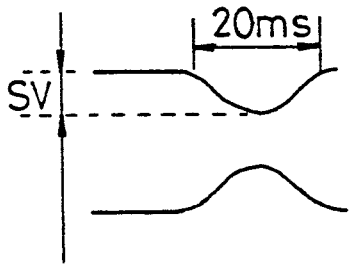
FIGS. 4 through 7 are diagrams showing signal waveforms illustrative of operation of the lapping apparatus shown in FIG. 3.
Figure 5:
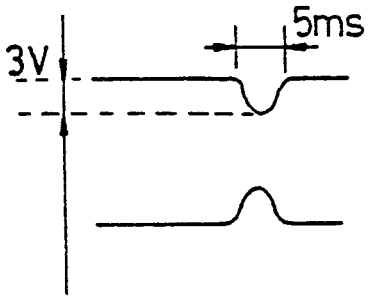
Figure 6:
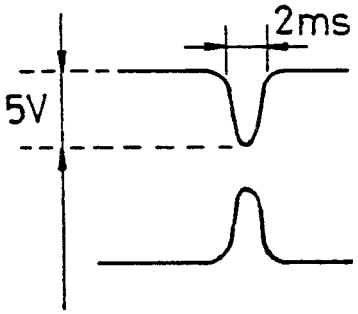
Figure 7:
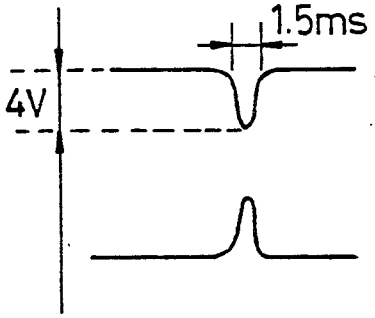

The dip detector 29 is constructed as shown in FIG. 2, for example. The output signal from the buffer amplifier 27 (FIG. 1) is applied through a amplifier 29*a* to an envelope detector 29*b*, which detects the envelope of the applied signal. The envelope detector 29*b* applies the detected output signal through an amplifier 29*c* to a low-pass filter 29*d* having a cutoff frequency of 10 KHz, then to a high-pass filter (HPF) 29*e* having a cutoff frequency of 5 KHz, and then to a low-pass filter (LPF) 29*f* having a cutoff frequency of 10 KHz. The cutoff frequencies of the filters 29*d*, 29*e*, 29*f* are given by illustrative example only, and the cutoff frequencies are suitable for the production of e.g. 10 MHz crystal wafer. Each of the filters 29*d*, 29*e*, 29*f* may comprise resistors, capacitors, and operational amplifiers, as is well known in the art. The low-pass filters 29*d*, 29*f* serve to remove high-frequency noise, and the high-pass filter 29*e* serve to differentiate the applied signal and detect its abrupt change. Consequently, these filters can lessen noise and detect an abrupt change (dip) in the signal envelope when the quartz crystal wafer 14 resonates. A dip in the signal envelope is essentially equal to a dip in the signal at the terminal P. The output signal from the high-pass filter 29*e* applied through the low-pass fitler 29*f* and a buffer amplifier 29*g* to a second coma-prator 29*h*, by which it is compared with a second reference voltage. When the voltage from the buffer amplifier 29*g* exceeds the second reference voltage, the comparator 29*h* produces a detected dip signal DT indicating a dip in the signal. The dip detector 29 has a second time constant (determined mainly by the cutoff frequencies of the filters 29*d*, 29*e*, 29*f*) shorter than that of the first comparator 30, and hence can detect a dip which is produced in the signal at the terminal P of the electrode 16 for a relatively short period of time.

More specifically, when the frequency of the sweep signal applied to the electrode 16 coincides with the resonant frequency of the quartz crystal wafer 14, the impedance of the quartz crystal wafer 14 abruptly decreases, and so is the signal level at the terminal P. Therefore, the frequency of the sweep oscillator 24 at the time the signal level is abruptly lowered may be virtually regarded as the resonant frequency of the quartz crystal wafer 14.

The detected dip signal DT from the dip detector 29 is then applied to the sweep control circuit 21 which stops transmitting the clock signal, so that the coutner 22 also stops counting up the clock signal. The detected dip signal DT is also supplied to a frequency detector 34.

In response to the detected dip signal, the frequency detector 34 checks the data stored in the memory 32 retrospectively (e.g. by decrementing the address of the memory 32) over a given period of time prior to the detection of the dip. Specifically, the frequency detector 34 determines whether the data stored in each of the addresses up to the tenth address, for example, counted retrospectively or decremented from the address indicated by the count of the counter 22 at the time the dip is detected, is "0" or "1". If the data in each of these addresses are "1", then the frequency detector 34 determines that the quartz crystal wafer 14 is positioned underneath the electrode 16, and reads the frequency from the sweep oscillator 24, which has been fixed in response to the detected dip signal DT, into its own register. After having read the frequency, the frequency detector 34 resets the count of the counter 22 to "0", cancels the detected dip signal DT from the dip detector 29, and resumes a dip detecting process.

Since the frequency of the signal from the sweep oscillator 24 is fixed in response to the signal DT and the data indicative of the presence of the quartz crystal wafer 14 underneath the electrode 16 is stored in the memory 32 for frequency detection, the frequency detector 34 is given a sufficient period of time in which to determine the frequency, resulting in an advantage for computerization. The retrospective check of the data stored in the memory 32 prevents the detection of a false dip which may be produced by contact of the carrier 13 with the electrode 16 mainly when the quartz crystal wafer 14 leaves from below the electrode 16.

A frequency determining circuit 35 checks the difference between frequency data which have been successively read into the register of the frequency detector 34. If the difference is smaller than a predetermined value, then the frequency determining circuit 35 determines the frequency data as indicating the true resonant frequency of the quartz crystal wafer 14. This process is based on the empirical finding that as the simultaneous lapping of plural quartz crystal wafers progresses, the resonant frequencies of the quartz crystal wafers become closer to each other.

A frequency comparator 36 compares frequency data representative of the true resonant frequency with predetermined target frequency data Fr. When the frequency comparator 36 detects, a plurality of times in succession, that the resonant frequency data lies within a predetermined allowable range from the target frequency data Fr, the frequency comparator 36 determines that the lapping process is completed.

When the lapping process is completed as detected by the frequency comparator 36, a drive unit control circuit 37 inactivates the drive unit 15 to stop the rotation of the carrier 13, and energizes a buzzer, a lamp, or the like to indicate the end of the lapping process.

Although a certain preferred embodiment has been shown and described, it should be understood that many changes and modifications may be made therein without departing from the scope of the invention.

What is claimed is:

1. An automatic lapping apparatus for lapping a piezoelectric material, comprising:

a pair of parallel, confronting lapping plates having confronting lapping surfaces;

a carrier disposed between said lapping plates, for holding a piezoelectric material sandwiched between the lapping surfaces of said lapping plates;

a drive unit for driving the carrier in a planetary motion between the lapping plates to lap the piezoelectric material parallel to the lapping surfaces while supplying a lapping slurry therebetween;

an electrode supported on one of said lapping plates in electrically insulated relationship thereto, said electrode having a tip end positioned at the lapping surface of said one lapping plate;

a counter for counting a clock signal having a constant frequency;

a digital-to-analog converter for converting the count of said counter into an analog signal corresponding to the count;

a sweep oscillator for generating a sweep signal whose frequency depends on the analog signal from said digital-to-analog converter;

an AGC amplifier for amplifying the sweep signal from said sweep oscillator to a fixed amplitude and applying the amplified sweep signal through a fixed resistor to a terminal of said electrode;

a comparator circuit for detecting the signal at the terminal of said electrode and comparing the detected signal with a first reference voltage with a relatively long first time constant to determine whether the piezoelectric material is present underneath said electrode;

a memory for storing output data from said comparator circuit at an address corresponding to the count of said counter;

a dip detector for detecting an envelope of the signal at the terminal of said electrode and detecting a dip in the signal based on a dip in said envelope with a second time constant which is shorter than said first time constant;

a sweep control circuit for inactivating said counter when the dip in the signal is detected by said dip detector;

a frequency detector for successively decrementing addresses of said memory from said address corresponding to the count of said counter for a predetermined number of times and reading the output data from the decremented addresses, when the dip in the signal is detected by said dip detector, and for reading the frequency generated by said sweep oscillator at the time the dip in the signal is detected, only when all the output data stored in said memory indicate the presence of the piezoelectric material underneath said electrode, as frequency data into a register thereof;

a frequency determining circuit for determining that the frequency data represent a true resonant frequency of the piezoelectric material when the difference between frequency data successively read into said register is smaller than a predetermined value;

a frequency comparator for determining that a lapping process is completed when said true resonant frequency determined by said frequency determining circuit falls within a given range from a predetermined target frequency; and a drive unit control circuit for controlling said drive unit to stop driving said carrier in response to the determination by said frequency comparator that the lapping process is completed.

* * * * *